United States Patent [19]

Furuya et al.

[11] 4,359,033

[45] Nov. 16, 1982

[54] EXHAUST GAS RECYCLING IN DIESEL ENGINES

[75] Inventors: Tadashi Furuya, Ageo; Shuji Ota, Omiya, both of Japan

[73] Assignee: Nissan Diesel Motors Co., Ltd., Saitama, Japan

[21] Appl. No.: 224,423

[22] Filed: Jan. 12, 1981

[30] Foreign Application Priority Data

Jan. 18, 1980 [JP] Japan ..... 55-3494

[51] Int. Cl.[3] ..... F02M 25/06

[52] U.S. Cl. ..... 123/569

[58] Field of Search ..... 123/569, 568, 571

[56] References Cited

U.S. PATENT DOCUMENTS 4,237,837 12/1980 Toda et al. ..... 123/569

4,279,235 7/1981 Flaig et al. ..... 123/569

*Primary Examiner*—Wendell E. Burns

*Attorney, Agent, or Firm*—Beveridge, DeGrandi & Kline

[57] ABSTRACT

The characteristics of a diesel engine exhaust gas recycling system are improved by reducing the percentage of the recycled exhaust gas in the low and high speed ranges of the engine. This is accomplished by the use of a conversion valve which decreases the input negative pressure to the vacuum amplifier which controls the recycling valve.

10 Claims, 13 Drawing Figures

FIG. 1
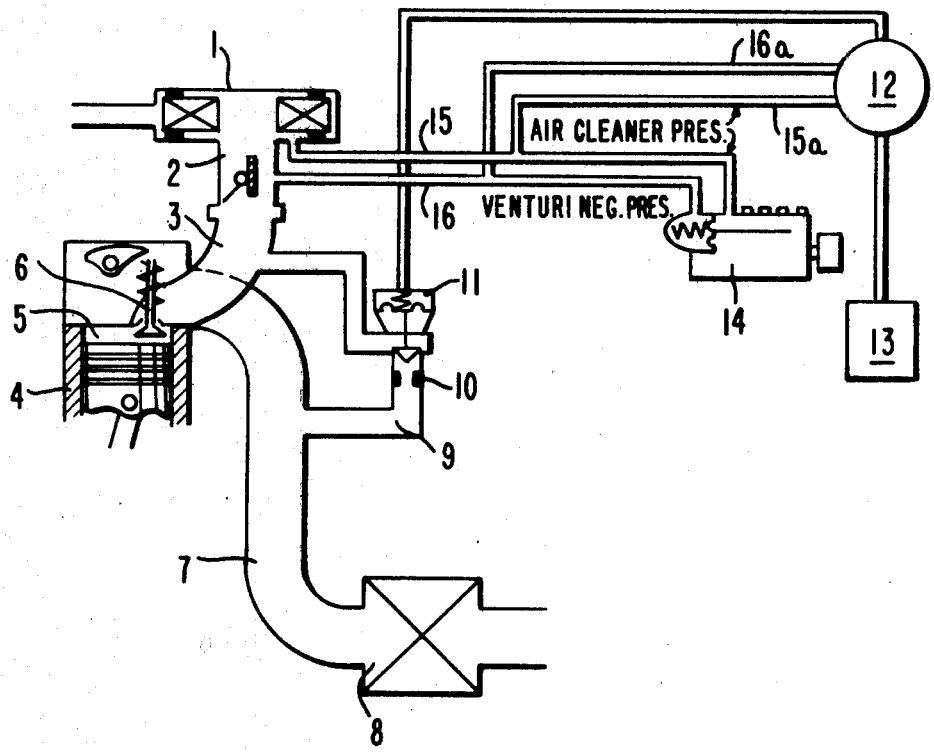
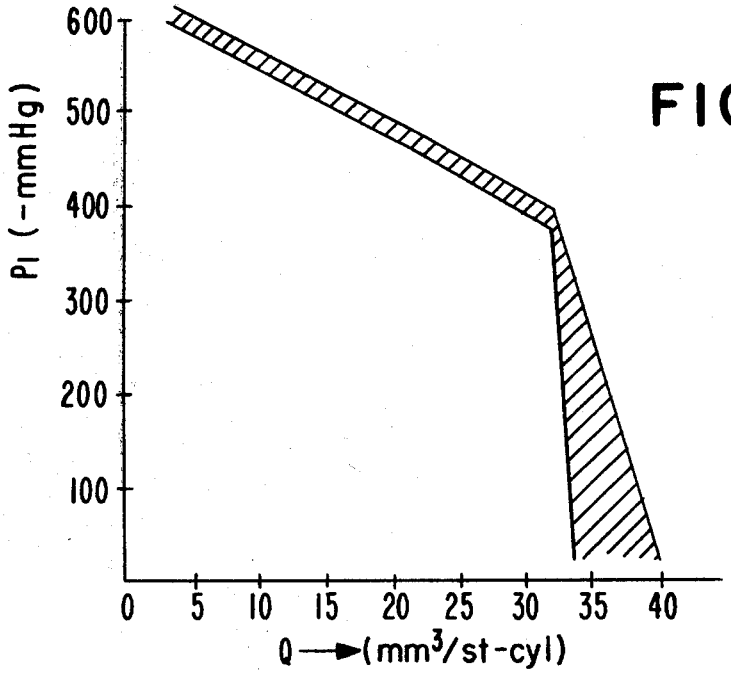
FIG. 2

FIG.3
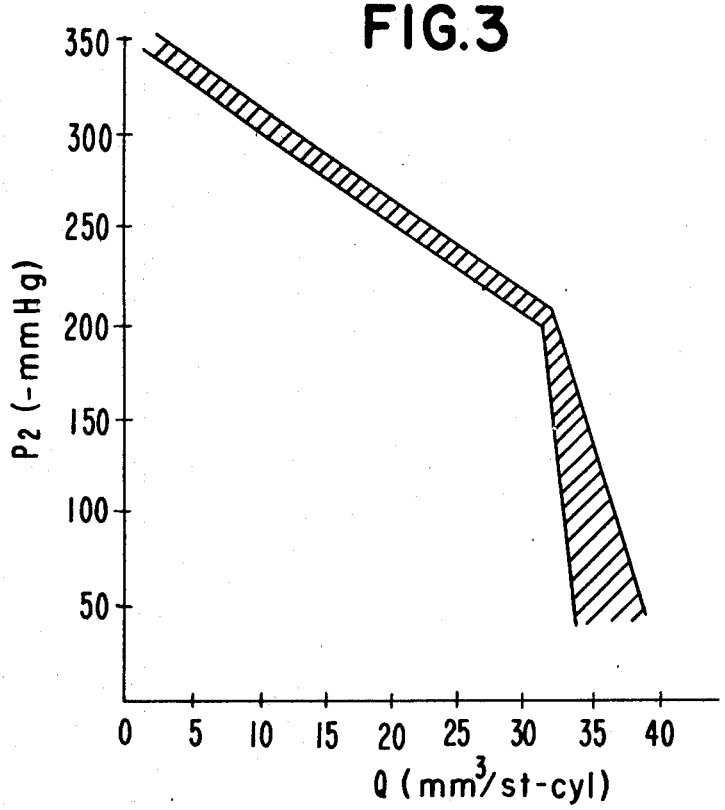
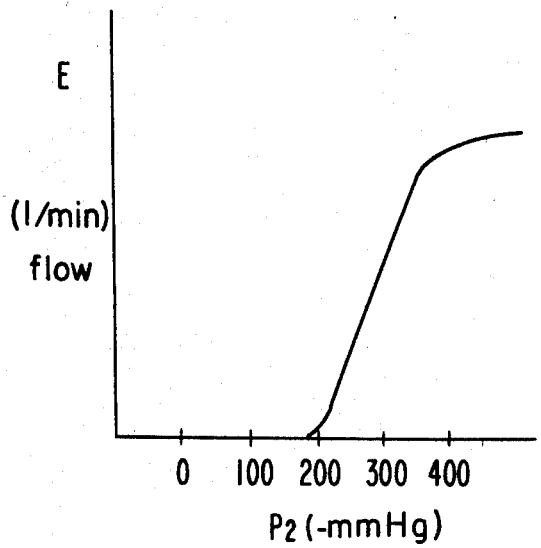
FIG. 4
FIG.7
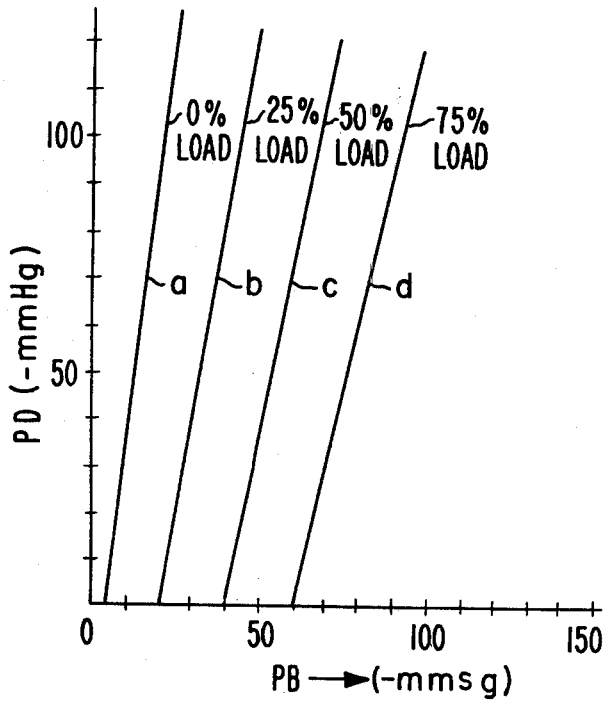

FIG. 5
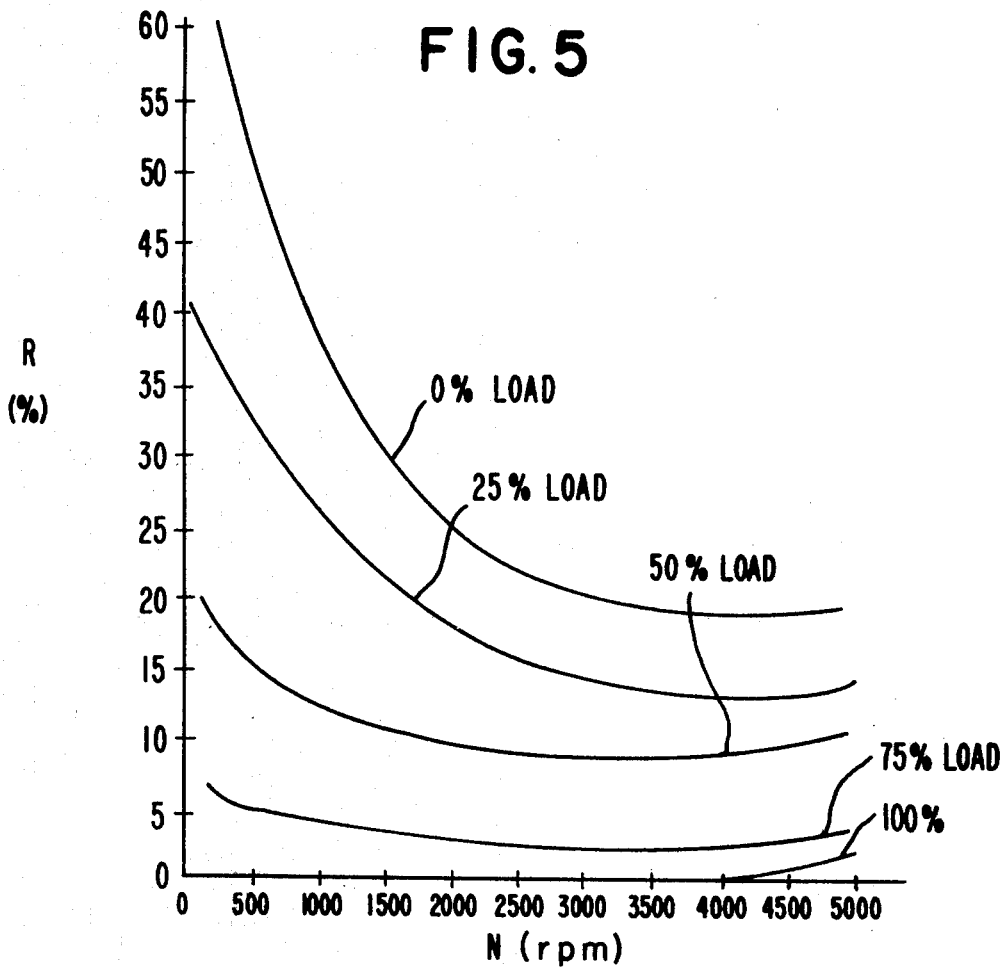
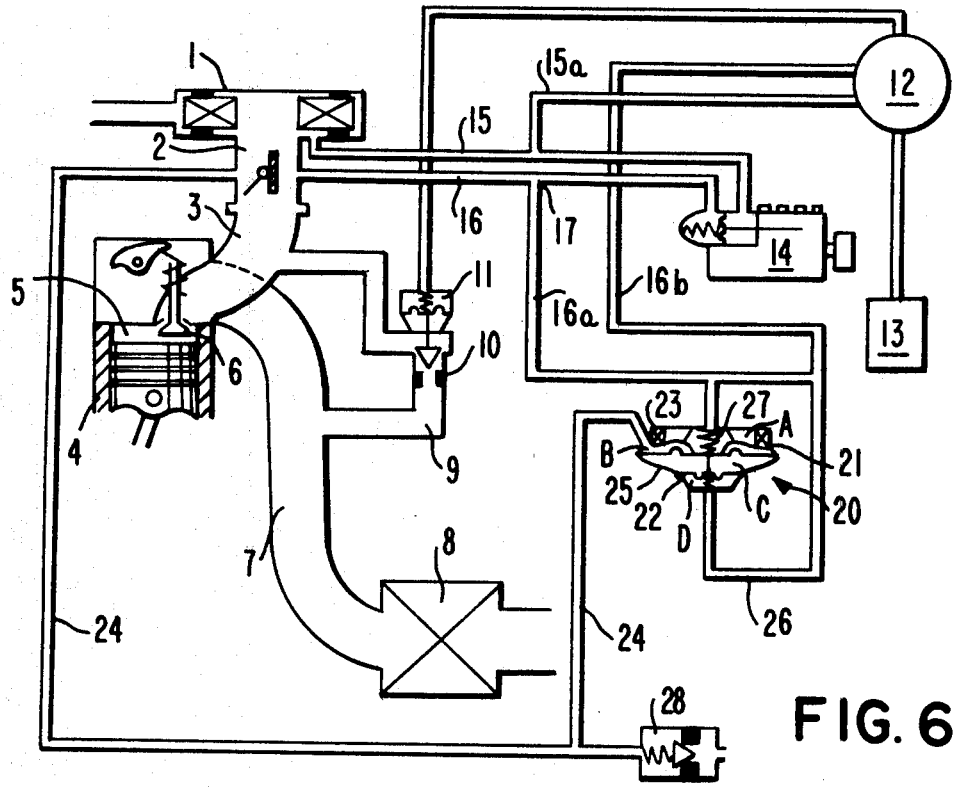
FIG. 6

EXHAUST GAS RECYCLING IN DIESEL ENGINES

BACKGROUND OF THE INVENTION

This invention concerns exhaust gas recycling systems, referred to as EGR systems, for diesel engines and relates in particular to such a system in which the quantity of fuel injected by its injection system pump is controlled by a pneumatic governor.

Reference is made to the conventional EGR system illustrated schematically in FIG. 1, wherein atmospheric air taken in through air cleaner 1 flows through venturi passage 2 and intake pipe 3 and enters combustion chamber 5 of cylinder 4 through inlet valve 6. The air cleaner 1, venturi passage 2, and intake pipe 3 can be regarded as an air infeed. Combustion gases escape into exhaust pipe 7 through an exhaust valve, not shown, and are discharged to the atmosphere through a muffler 8.

In this prior system, part of the exhaust gases is recycled to the combustion chamber through branch line 9, orifice 10, EGR valve 11 and intake pipe 3, the amount of recycled gases being dependent on the extent with which EGR valve 11 is open where all other conditions are held constant. EGR valve 11 opens under the influence of the negative pressure produced by vacuum pump 13 and supplied under control by amplifier 12. Injection pump 14 for injecting fuel into combustion chamber 5 through the injection nozzle is communicated to air cleaner 1 through line 15 and also to venturi passage 2 through line 16. Pump 14 includes a vacuum governor which controls the pump according to the difference between the two pressures sampled on lines 15 and 16, one being more negative than the other, to control the rate and quantity of fuel injection in the known manner: the governor actuates and positions the fuel control rack in the pump.

The EGR characteristics of such a conventional system are illustrated in the graphs of FIGS. 2, 3, 4 and 5, all being based on the data taken on a particular diesel engine.

In the graph of FIG. 2, the differential pressure mentioned above (i.e., the difference between pressures on lines 15 and 16) is plotted as $P_1$ on the vertical axis and the injection quantity is designated as Q on the horizontal axis. In the conventional EGR system, the characteristic shown in FIG. 2 is determined primarily by the operating characteristic of the vacuum governor fitted to the injection pump. In other words, the vacuum governor is present to actuate and position the control rack in response to the said differential pressure according to the indicated characteristic.

The system shown in FIG. 1 uses a vacuum amplifier 12 and a vacuum pump 13 because the negative venturi pressure is not high enough to actuate directly the exhaust gas recycling valve 11 in the conventional system. It has been heretofore customary in diesel engines with conventional exhaust gas recycling of this type to boost the negative pressure available from the venturi passage and this need has been met by such an amplifier and a vacuum pump. Referring to the system of FIG. 1, this boosting or amplification is accomplished by admitting two negative-pressure inputs to amplifier 12: one is air cleaner pressure, varying with engine speed as shown in FIG. 13, from line 15 through branch line 15*a*; and the other is venturi pressure from line 16 through branch line 16*a*. Operating with these inputs, vacuum amplifier 12 controls the negative-pressure output applied to EGR valve 11.

The graph of FIG. 3 shows the output $P_2$ of the vacuum amplifier on the vertical axis and fuel injection quantity Q on the horizontal axis to indicate the relationship between the amplifier output and the injection quantity. It must be pointed out that this relationship or characteristic is that which is preset, and is similar to that shown in FIG. 2. With this amplifier output characteristic, if recycling is to be effected in the $P_2$ range above the level where $P_2$ is equal to negative 200 mm Hg, the flowrate E of recycled gases will vary with $P_2$ in a manner depicted by the curve of FIG. 4, in which the vertical axis is scaled for flowrate E (liters/minute) and the horizontal axis for output $P_2$ (negative mm Hg).

In the theoretical system characterized by FIGS. 2, 3 and 4, the proportion of recycled gases to the total intake of the cylinder, i.e., the EGR ratio, will vary with engine speed N according to the curves of FIG. 5, there being five curves representing 0%, 25%, 50%, 75% and 100% of the rated engine load. Note that the variation of percent EGR ratio differs for different levels of engine load. The percent EGR ratio, designated R, is defined by this expression:

$$EGR \text{ ratio} = R = \frac{\text{volume of recycled exhaust gases}}{\text{total intake volume of engine cylinders}} \times 100\ (\%)$$

From the curves of FIG. 5, it can be seen that the EGR ratio increases with decreasing speed in the low speed range and also with increasing speed in the high speed range. This relationship between the EGR ratio R and the engine speed N is believed to arise from the fact that, for a given engine load and a given negative-pressure input to the EGR valve with a consequently constant valve lift, the amount of recycled gases increases with speed in the high speed range because the pressure in the exhaust pipe increases. Under the same conditions, in the low speed range the total intake volume of the engine becomes smaller relative to the amount of recycled gases as engine speed decreases. This relationship or system characteristic has heretofore presented two problems, which are:

(1) If the system is set with a specific EGR ratio calculated to cover the entire range of engine speed, the actual ratio will increase in the low speed range because of the characteristic described above. This will deteriorate fuel combustion, resulting in an increasingly large proportion of hydrocarbons in the exhaust gases, giving these gases a black color and an offensive odor.

(2) In the high speed range, the larger the engine load, the higher the pressure inside the exhaust pipe; and, where the EGR valve is of a type opening at a certain level of actuating vacuum, the higher the engine speed, the higher will be the load level at which this valve opens. In other words, the engine will tend to lack power as its speed rises in the high-speed maximum-load range.

SUMMARY OF THE INVENTION

The object of the present invention is to overcome the two drawbacks of the conventional system by providing an improved system by which the flowrate of recycled gases in the low speed range can be kept equal to or below that of the EGR ratio established in advance, regardless of engine load. At the same time, the maximum horsepower output in the high speed range can be secured, allowing its predetermined EGR ratio to be smaller than that fixed for the entire speed range in the conventional system, in order to enhance the durability of the engine.

BRIEF DESCRIPTION OF THE DRAWINGS

FIGS. 1–5 relate to prior art devices, while FIGS. 6–13 relate to the invention.

FIG. 1 is a schematic diagram of the conventional exhaust gas recycling system.

FIG. 2 is a graph showing the pressure difference between the venturi constriction and air cleaner, as a function of fuel injection quantity.

FIG. 3 is a graph showing the output of the vacuum amplifier as a function of fuel injection quantity.

FIG. 4 is a graph showing the flowrate of recycled gases as a function of amplifier output.

FIG. 5 is a graph showing the speed characteristic of the percent EGR ratio, under different engine load conditions.

FIG. 6 is a schematic diagram of the EGR system of the preferred embodiment of this invention.

FIG. 7 is a graph showing the negative-pressure output of the vacuum conversion valve as a function of the negative pressure available at a point between the venturi and the air cleaner.

DETAILED DESCRIPTION OF THE INVENTION

A preferred embodiment of the EGR system according to this invention will be described with reference to FIGS. 6 through 10, inclusive, and a modification thereof with reference to FIG. 11.

Figure 12:
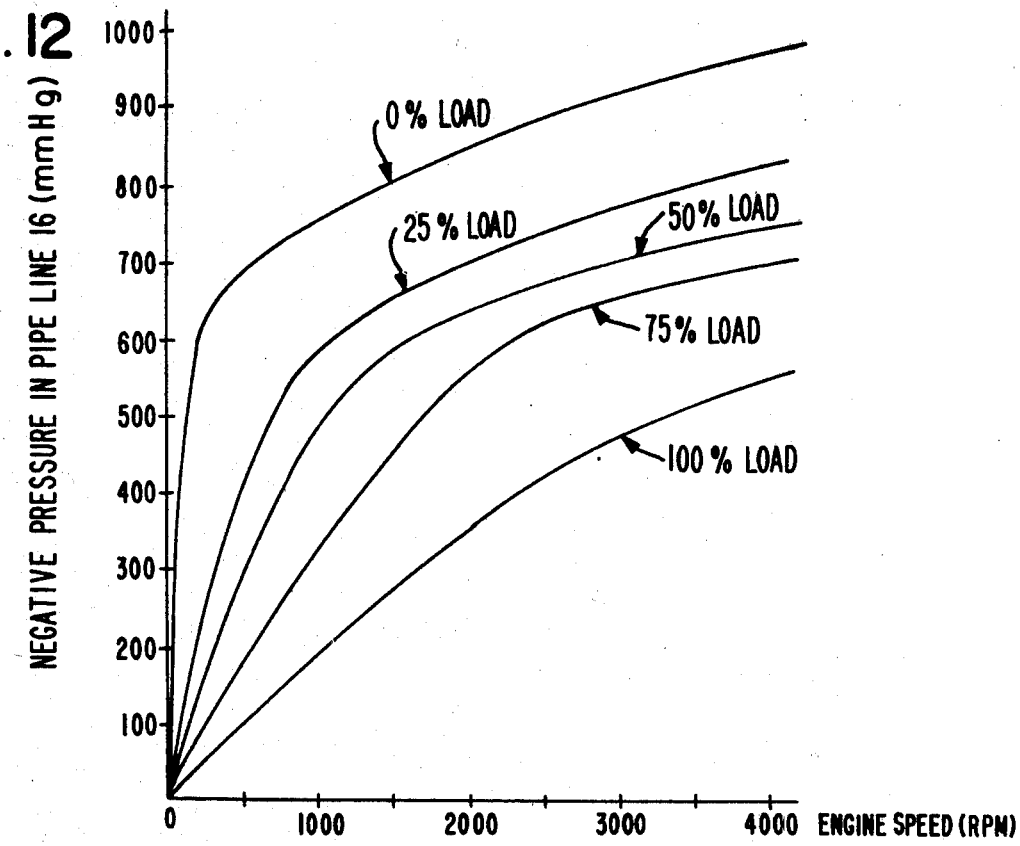
FIG. 12 is a graph showing the negative venturi pressure in line 16 as a function of engine speed for different levels of engine load.

In the EGR system represented in FIG. 6, similar parts and components have reference numerals which correspond to those of the conventional system of FIG. 1. However, branch line 16*a* has orifice 17 and divides into two parallel lines, which converge into a single line 16*b* extending to vacuum amplifier 12 to transmit negative venturi pressure to the amplifier, this pressure varying with load and engine speed as shown in FIG. 12. In one of the parallel lines there is a venturi-pressure conversion valve 20 which has an inlet terminated at a valve 27 and an outlet connected to output line 26.

Figure 13:
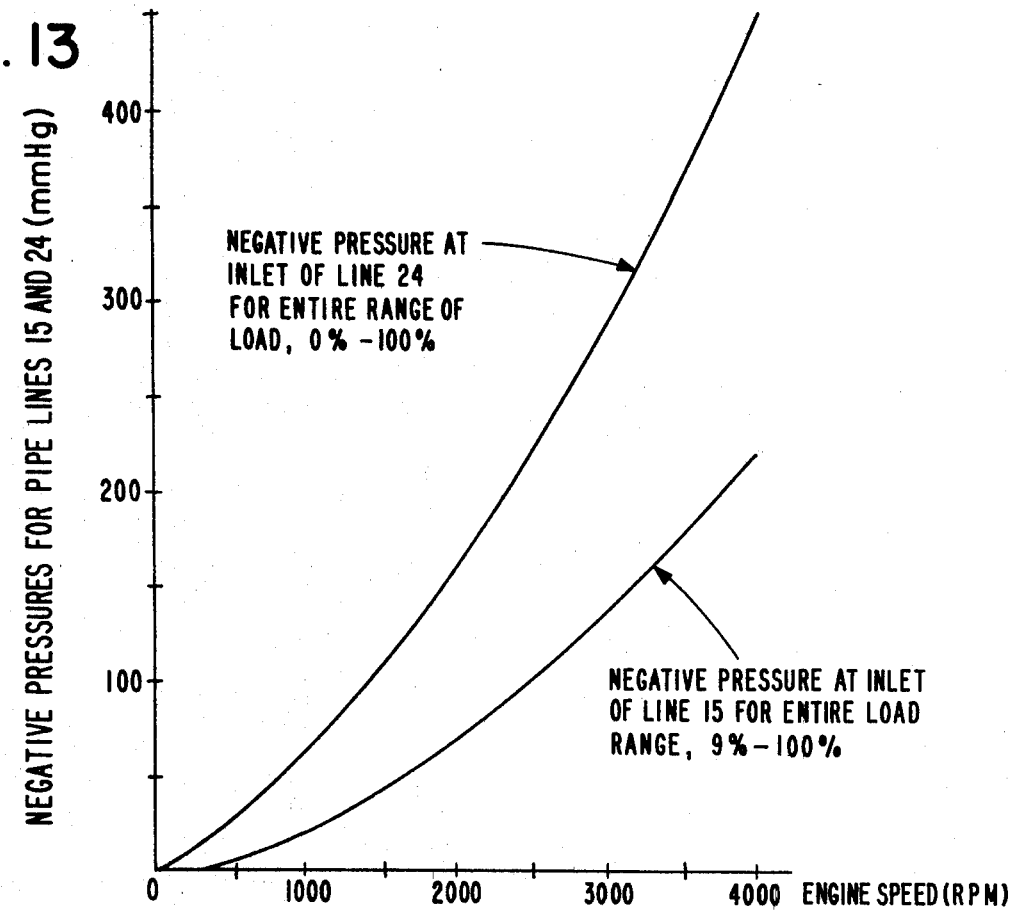
FIG. 13 indicates the negative pressures in lines 15 and 24 as functions of engine speed.

The negative venturi pressure input to the vacuum amplifier is modified by the conversion valve 20. Conversion valve 20 has four chambers A, B, C and D, and two spring-based pressure-sensitive diaphragms 21 and 22. Diaphragm 21 separates chambers B and C and diaphragm 22 spearates chambers C and D. Chamber A communicates to the atmosphere through filtering element 23; and chamber B communicates through line 24 to part of the intake passage between air cleaner 1 and venturi 2, so that its internal negative pressure varies in proportion to changes in engine speed as shown in FIG. 13. Chamber C communicates to the atmosphere through its opening 25; and chamber D is a feedback chamber which communicates to vacuum amplifier 12 through line 26. The negative pressure produced by conversion in valve 20 from the negative venturi pressure appears in chamber D and is the output of valve 20.

Diaphragms 21 and 22 are rigidly linked to deflect together. A seat is centrally formed in diaphragm 21, confronting the inlet pipe 27 whose inner end meets the seat to isolate branch line 16*a* from chamber A. The sizes of diaphragms 21 and 22 and the characteristics of the springs which bias the diaphragms 21 and 22 toward chamber C are such that, when the negative pressure in chambers B and D are low, the two diaphragms both deflect toward chamber D to unseat inlet pipe 27, thereby admitting atmospheric pressure into branch line 16*a* to reduce the negative venturi pressure in this line. Since line 16*a* is tied into output line 26, the negative venturi pressure applied to vacuum amplifier 12 through branch line 16*b* falls.

As the engine speed increases, negative pressure in chamber B rises as will be seen in FIG. 12. When this rising negative pressure, with its negative force acting on diaphragm 21, overcomes the counteracting force due mainly to the negative pressure of chamber D acting on diaphragm 22, diaphragm 21 deflects to bring its seat toward inlet pipe 27, thereby restricting the admission of atmospheric air into output line 26 through line 16*a*. Thereafter, the negative pressure in the output line 24 and branch line 16*a* begins to rise and approach the existing negative venturi pressure applied through orifice 17 located at the branching point of line 16*a*.

If engine speed continues to rise further, pipe valve 27 will be closed completely. Consequently, the output negative pressure of conversion valve 20 will rise to a level equal to that in the negative venturi pressure line 16, causing the vacuum amplifier 12 to operate as if conversion valve 20 were eliminated from the system. The EGR characteristic of the system under this condition is similar to that of the conventional system.

Figure 8:
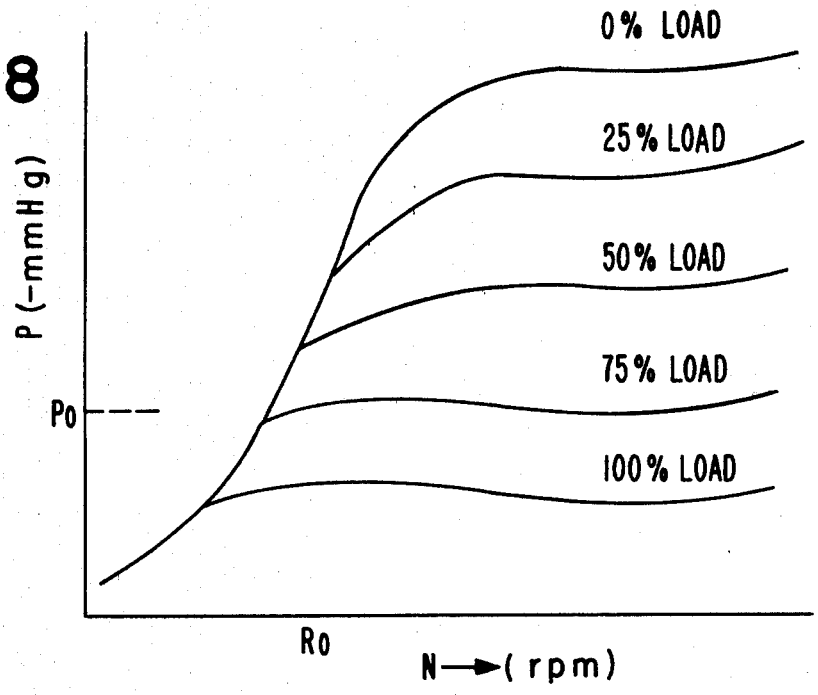
FIG. 8 is a graph showing the speed characteristic of vacuum amplifier output.

The characteristics of venturi-pressure conversion valve 20 constructed as above are indicated in the graphs of FIGS. 7 and 8. In FIG. 7, the negative pressure PB of chamber B is scaled on the horizontal axis and the negative pressure PD of chamber D is on the vertical axis; in FIG. 8, engine speed N is scaled on the horizontal axis and the output pressure P of vacuum amplifier 12 is on the vertical axis.

From the indicated relationship between PB and PD and between N and P, it will be seen that, if the EGR valve 11 is set to start opening at a certain level $P_o$ of increasing negative output pressure P, and as engine load decreases, exhaust gas recycling will commence at 75% engine load. As engine load decreases further, the percent EGR ratio will increase until a certain level $R_o$ of falling engine speed N is reached. It will be seen also that, at engine speeds below $R_o$, EGR valve 11 remains closed, resulting in no recycling of exhaust gases.

Figure 9:
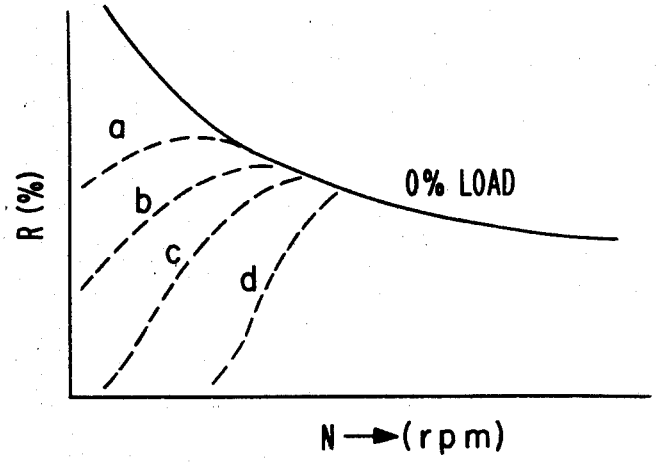
FIG. 9 is a graph showing the speed characteristic of the percent EGR ratio.

The graph of FIG. 9 applicable to the same conversion valve, shows the relationship between engine speed N on the horizontal axis and EGR ratio on the vertical axis. It indicates that the engine speed for commencing gas recycling and the EGR ratio for the low speed range can be set as desired by varying the effective-area ratio of one diaphragm to the other, by varying the preloads of the biasing springs, or by varying the size of the orifice in pipe valve 27 which restircts the rate of atmospheric air admission from chamber A.

The desirable tendency of the EGR ratio to decrease in the high speed range can be secured by using a check valve 28, as shown in FIG. 6, at an intermediate point in line 24, to admit atmospheric air into this line when the negative pressure in chamber B rises to a certain predetermined level, thereby limiting the pressure in chamber B to that level. Check valve 28 so provided will open at a certain level of rising engine speed to inject atmospheric air into chamber B, whereby the diaphragms deflect away from pipe valve 27 to bleed atmospheric air from chamber A into line 16*a*. This reduces the negative venturi pressure in this line, thereby reducing the negative output pressure of conversion valve 20 applied to amplifier 12 to decrease the high-speed range EGR ratio.

Figure 10:
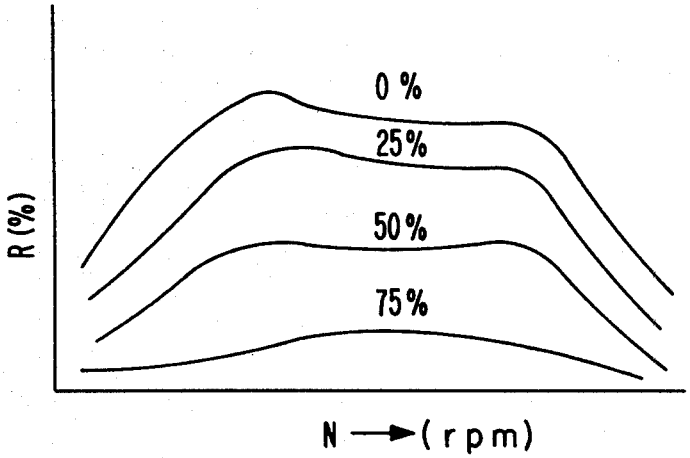
FIG. 10 is a graph illustrating the effectiveness of this invention by showing the speed characteristic of the percent EGR ratio.
Figure 11:
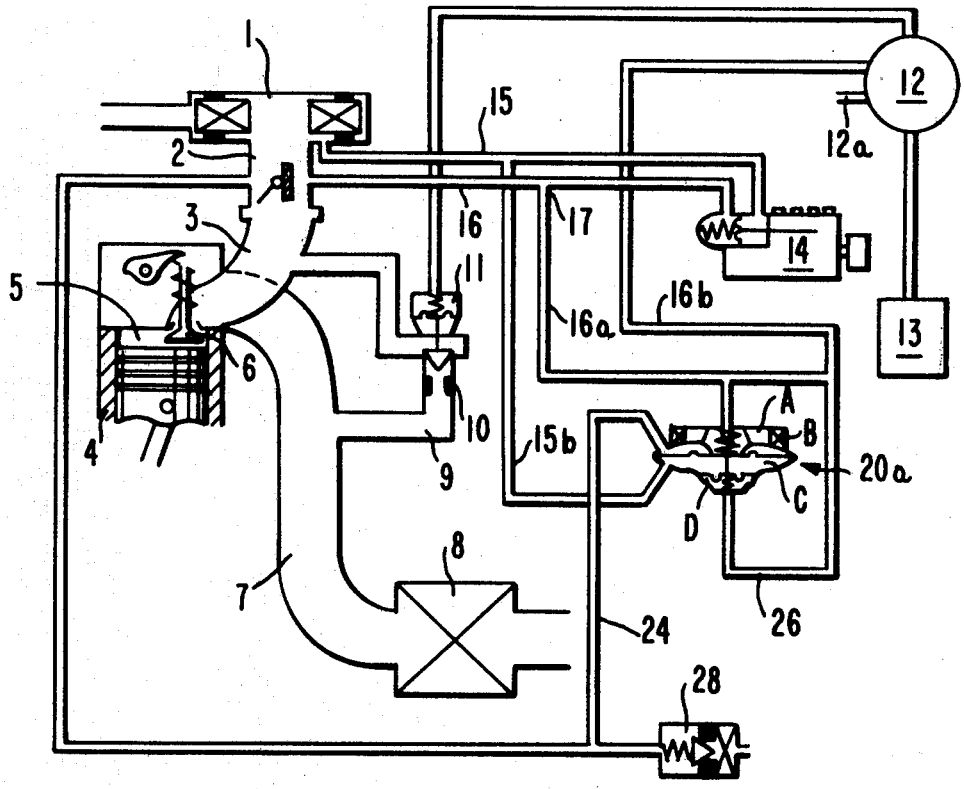
FIG. 11 is a schematic diagram showing another EGR system as a modification of the preferred embodiment of this invention.

The desired speed characteristic of the EGR ratio of the system indicated in FIG. 10 can be obtained through the actions, described thus far, of the conversion valve 20 operating in response to the negative pressure transmitted through line 24 to its chamber B. These valve actions alter or convert the negative venturi pressures in line 16*a* applied as an input to vacuum amplifier 12. Thus the negative venturi pressure input to vacuum amplifier 12 is modified at the upper and lower speed ranges of the engine to reduce the amount of gas recycled by the recycling valve from the amount that would be recycled without such modification.

A modification of the preferred embodiment of this invention described above is illustrated in FIG. 11, in which the negative pressure present in the air cleaner is admitted into chamber C of conversion valve 20 via branch line 15*b*. The modified system provides that the amplifier has an opening 12*a* at its input connection. The functional difference between the two embodiments arises from the substitution of air cleaner pressure for atmospheric pressure in chamber C and vice versa for input 12*a* to vacuum amplifier 12, but the modified system provides the desired EGR ratio characteristic indicated in FIG. 10.

Although line 15 transmits the negative air cleaner pressure to the bias-spring side in the vacuum governor on the fuel injection pump according to this invention, the source of pressure for that side in the governor need not be limited to the air cleaner. As is well known, this pressure source may be the kinetic pressure available at the upstream side of the venturi constriction, the negative pressure between air cleaner and venturi, or even atmospheric pressure.

It will be understood from the foregoing description that the EGR system according to this invention automatically controls the EGR ratio over the entire range of engine speeds to maintain a proper ratio of volume of recycled exhaust gases to total intake volume of the engine cylinder, thereby reducing hydrocarbon emission in the exhaust and improving the horsepower output performance of the engine.

We claim:

1. An exhaust gas recycling system for diesel engines having air infeeds comprising an exhaust gas recycling valve for recycling part of the exhaust gases from the engine exhaust to the engine air infeed, a vacuum pump for actuating said recycling valve, a vacuum amplifier coupled to and controlling said recycling valve in response to an input negative pressure in said air infeed, and means operable between the air infeed and the vacuum amplifier for modifying the negative pressure which controls the vacuum amplifier.

2. An exhaust gas recycling system as claimed in claim 1 wherein said means for modifying said negative pressure modifies said pressure at the upper and lower speed ranges of said engine to reduce the amount of exhaust gas recycled by said recycling valve from the amount that would be recycled without such modification.

3. An exhaust gas recycling system as claimed in either claim 1 or claim 2 wherein said means for modifying said negative pressure comprises a device having a first chamber, a second chamber, a third chamber and a fourth chamber, said second and third chambers being separated by a first pressure sensitive diaphragm, said third and fourth chambers being separated by a second pressure sensitive diaphragm, said first and second diaphragms being rigidly linked to deflect together in response to changes in differential pressure in the respective chambers, said first diaphragm having a valve seat portion thereon, said first chamber communicating to the atmosphere and having a port communicating with said negative pressure input to said vacuum amplifier therein to cooperate with said valve seat portion to form a valve, whereby atmospheric pressure is communicated to said port when said valve is open, said second chamber communicating to a point in said air infeed which is upstream of the point where said air infeed is coupled to the vacuum amplifier, said third chamber communicating with the atmosphere, and said fourth chamber communicating with said negative pressure input to said vacuum amplifier.

4. An exhaust gas recycling system as claimed in claim 3 wherein the area of said first diaphragm exposed to the pressures in said second and third chambers is greater than the area of said second diaphragm exposed to the pressures in said third and fourth chambers.

5. An exhaust gas recycling system as claimed in claim 4 wherein said second chamber communicates with the atmosphere through a check valve set to open when atmospheric pressure exceeds the pressure in the second chamber by a predetermined amount.

6. An exhaust gas recycling device as claimed in claim 5 wherein said device includes spring means to bias said diaphragms to open said valve in said first chambers when the negative pressures in said second and fourth chambers are low.

7. A method of recycling exhaust gas from a diesel engine exhaust to the engine air infeed comprising the steps of opening a recycling valve between said engine exhaust and said infeed in response to a negative pressure produced by a vacuum pump and controlled by a vacuum amplifier responsive to an input negative pressure in said infeed, and modifying the negative pressure taken from said infeed before applying it as an input to said vacuum amplifier.

8. A method of recycling as claimed in claim 7 including modifying said negative pressure at the upper and lower speeds of said engine to reduce the amount of exhaust gas recycled by said recycling valve from the amount that would be recycled without such modification.

9. A method as claimed in either claim 7 or claim 8 comprising admitting atmospheric pressure to said negative pressure input to said vacuum amplifier at low engine speeds.

10. A method as claimed in claim 9 comprising bleeding atmospheric pressure to said negative pressure input to said vacuum amplifier at high engine speeds.

* * * * *